US011809112B2

(12) United States Patent
Osada et al.

(10) Patent No.: US 11,809,112 B2
(45) Date of Patent: Nov. 7, 2023

(54) IMAGE HEATING DEVICE AND IMAGE FORMING APPARATUS

(71) Applicant: CANON KABUSHIKI KAISHA, Tokyo (JP)

(72) Inventors: Hikaru Osada, Kanagawa (JP); Masashi Tanaka, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/831,968

(22) Filed: Jun. 3, 2022

(65) Prior Publication Data

US 2022/0404744 A1 Dec. 22, 2022

(30) Foreign Application Priority Data

Jun. 10, 2021 (JP) ..... 2021-097422

(51) Int. Cl.
*G03G 15/20* (2006.01)

(52) U.S. Cl.
CPC ..... *G03G 15/206* (2013.01)

(58) Field of Classification Search
CPC ..... G03G 15/206; G03G 15/2017; G03G 15/2053; G03G 2215/2003; G03G 2215/2016; G03G 2215/2035
See application file for complete search history.

(56) References Cited

U.S. PATENT DOCUMENTS

2013/0078017 A1* 3/2013 Imaizumi ..... G03G 15/2053 399/329
2015/0139706 A1* 5/2015 Fujiwara ..... G03G 15/2064 399/329
2018/0284661 A1* 10/2018 Endo ..... G03G 15/2053
2018/0284670 A1* 10/2018 Takematsu ..... G03G 15/206

FOREIGN PATENT DOCUMENTS

JP H0444080 A 2/1992
JP 2010139908 A 6/2010
JP 2016194592 A 11/2016
JP 2017009894 A 1/2017

* cited by examiner

*Primary Examiner* — Sandra Brase
(74) *Attorney, Agent, or Firm* — ROSSI, KIMMS & McDOWELL LLP

(57) ABSTRACT

Provided is an image heating device that heats an image in a nip portion, including: a film; a heater; a roller that forms the nip portion with the film; a backup member; regulating members that regulate a movement of the film and move along with the backup member; and a frame that includes a guide portion to insert the regulating members and a shaft of the roller. The roller includes an elastic layer that is deformed by being pressed from a side which the film is placed, such that a distance between a rotation axis of the roller and the nip portion decreases, and that a volume of the elastic layer decreases. The guide portion guides so that the regulating members move more to a downstream side in a conveying direction of the recording material as the regulating members approach the rotation axis of the roller.

10 Claims, 12 Drawing Sheets

A-A CROSS-SECTIONAL VIEW

B-B CROSS-SECTIONAL VIEW

A-A CROSS-SECTIONAL VIEW

B-B CROSS-SECTIONAL VIEW

IMAGE HEATING DEVICE AND IMAGE FORMING APPARATUS

BACKGROUND OF THE INVENTION

Field of the Invention

The present invention relates to an electrophotographic type image forming apparatus, such as a printer and copier. The present invention also relates to an image heating device, such as a glossing apparatus, that improves a gloss value of a toner image by reheating a toner image fixed to a fixing unit of an image forming apparatus or a recording material.

Description of the Related Art

A film heating type fixing device is known as a toner fixing device that is used for an electrophotographic type image forming apparatus. The film heating type fixing device normally includes a tubular film, a nip portion forming member that contacts with the inner surface of the film, and a roller which forms the nip portion along with the nip portion forming member via the film. A recording material carrying a toner image is held and conveyed through the nip portion while being heated, whereby the toner image is fixed to the recording material.

However, when the film is rotated to fix the toner image in the film heating type fixing device, in some cases the film may move in the rotation axis direction of the roller (shift of the film). In the fixing device, a regulating member which regulates the shift of the film is disposed, as disclosed in Japanese Patent Application Publication No. H04-044080, but if a force which is applied to the film in the rotation axis direction of the film is too strong, problems may occur, such as damage to the edge portion of the film, and an imbalance in the pressing force during fixing.

SUMMARY OF THE INVENTION

When a film rubs against a regulating member that regulates a shift of the film for a long period of time, the edge portion of the film contacting with the regulating member may be damaged (e.g. bent). Particularly in recent years, longer life and higher speeds are demanded for the image forming apparatus, including the fixing device. As the life of the fixing device increases, the time when the film rubs against the regulating member also increases. Further, as the speeds of the apparatus increases, the film tends to shift even more. Therefore preventing damage to the edge portion of the film becomes a critical issue.

With the foregoing in view, it is an object of the present invention to provide an image heating device that reduces a shifting force generated on the film, and to minimize damage to the edge portion of the film.

In order to solve the above problem, an image heating device of the present invention that heats a recording material on which an image is formed, while conveying the recording material, so as to heat the image in a nip portion, comprises:

a rotatable tubular film;

a heater that heats the film;

a rotatable roller that contacts an outer peripheral surface of the film, and forms the nip portion with the film, to convey the recording material;

a backup member that is disposed in an internal space of the film all through a longitudinal direction of the film, and supports an inner peripheral surface of the film;

regulating members that are disposed to face both ends of the film in the longitudinal direction respectively, so as to regulate a movement of the film in the longitudinal direction, and to move along with the backup member;

a frame of the apparatus, that includes a guide portion to insert the regulating members and a shaft of the roller; and a pressing mechanism that applies force to the regulating members so as to apply pressure to the nip portion, wherein the roller includes an elastic layer that is deformed by being pressed from a side which the film is placed, such that a distance between a rotation axis of the roller and the nip portion decreases and that a volume of the elastic layer decreases, wherein the guide portion guides so that the regulating members move more to a downstream side in a conveying direction of the recording material as the regulating members approach the rotation axis of the roller.

An image heating device of the present invention that heats a recording material on which an image is formed, while conveying the recording material, so as to heat the image in a nip portion, comprises:

a rotatable tubular film;

a heater that heats the film;

a rotatable roller that contact an outer peripheral surface of the film, and forms the nip portion with the film, to convey the recording material;

a backup member that is disposed in an internal space of the film all through a longitudinal direction of the film, and supports an inner peripheral surface of the film;

regulating members that are disposed to face both ends of the film in the longitudinal direction respectively, so as to regulate a movement of the film in the longitudinal direction, and to move along with the backup member;

a frame of the apparatus, that includes a guide portion to insert the regulating members and a shaft of the roller; and a pressing mechanism that applies force on the regulating members so as to apply pressure to the nip portion, wherein the roller includes an elastic layer that is deformed by being pressed from a side which the film is placed, such that a distance between a rotation axis of the roller and the nip portion decreases, and that a volume of the elastic layer remains constant, wherein the guide portion guides so that regulating members move more to an upstream side in a conveying direction of the recording material as the regulating members approach the rotation axis of the roller.

According to the present invention, an image heating device that reduces the shifting force generated on the film and minimizes the damage to the edge portion of the film can be provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
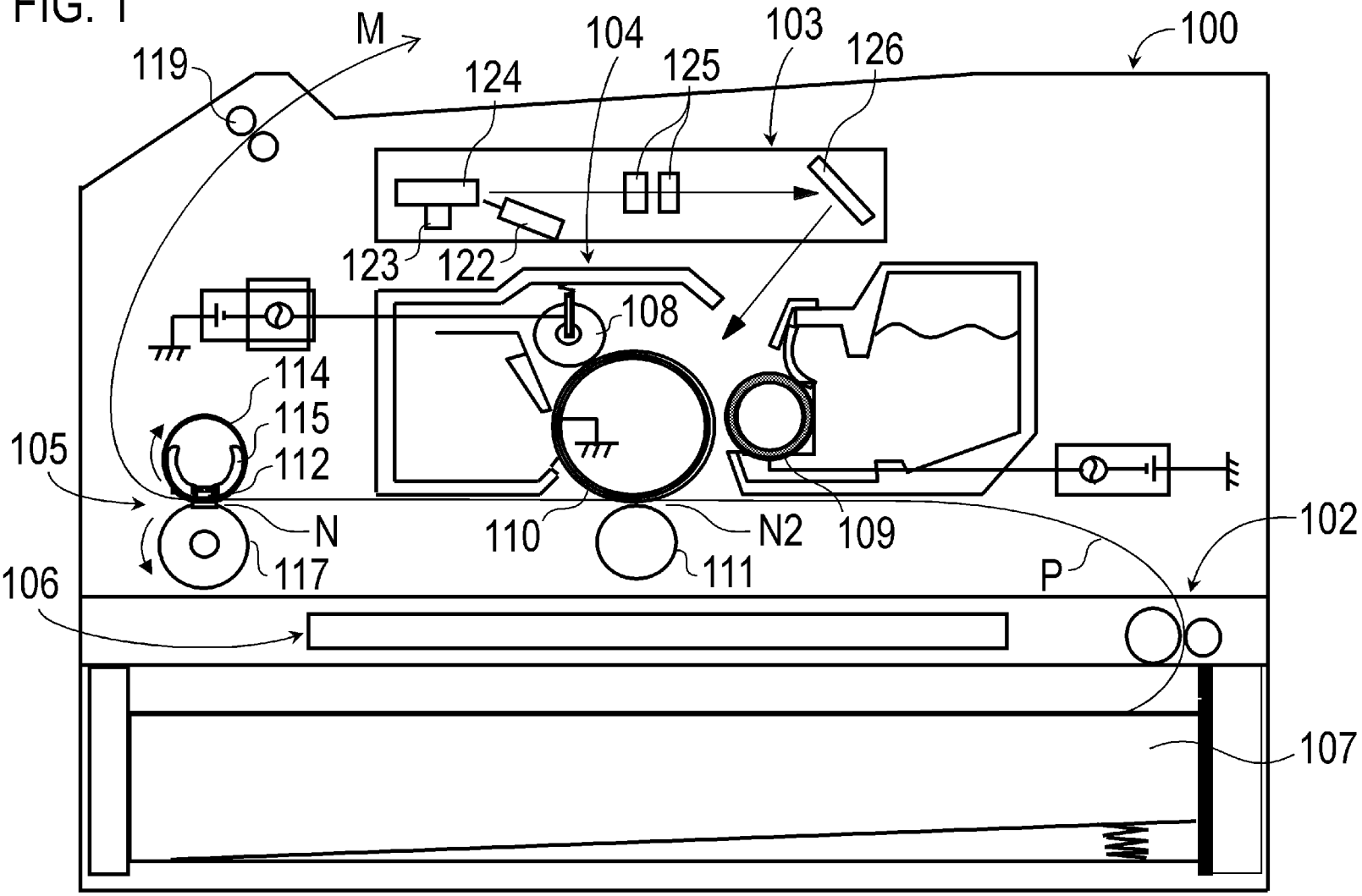
FIG. 1 is a schematic cross-sectional view of an image forming apparatus equipped with a fixing device according to Embodiment 1.

FIG. 1 is a schematic cross-sectional view of an image forming apparatus 100 according to an embodiment of the present invention using an electrophotographic recording technique. An image forming apparatus to which the present invention can be applied is electrophotographic type or electrostatic recording type copiers and printers, for example, and a case of applying the present invention to a laser printer, which forms an image on a recording material P (e.g. a recording paper) using the electrophotographic system will be described here.

(1) Image Forming Apparatus 100

FIG. 1 is a schematic cross-sectional view of an image forming apparatus equipped with a fixing device according to Embodiment 1. The image forming apparatus 100 includes: a paper feeding portion 102 which separates the loaded recording materials P one by one, and conveys each recording material P; and a laser scanner unit 103 which irradiates an image forming portion with a laser beam which is modulated and emitted based on image data provided by an external device. The image forming apparatus 100 further includes: an image forming portion 104 which forms an image by being irradiated with the laser beam from the laser scanner unit 103; a fixing device 105 which fixes the image to the recording material P by supplying heat and applying pressure; and a control device 106 which controls the sequence of each portion and device mentioned above. The laser scanner unit 103 includes a laser unit 122 which modulates and emits a laser beam based on the image data provided by an external device. The laser scanner unit 103 further includes: a polygon mirror 124 to scan with the laser beam emitted from the laser unit; a motor 123 to rotate the polygon mirror 124; an imaging lens group 125; and a reflecting mirror 126.

(2) Image Forming Procedure

An image forming procedure by the image forming apparatus 100 will be described with reference to FIG. 1. In the paper feeding portion 102 of the image forming apparatus 100 illustrated in FIG. 1, the recording materials P are separated one by one and fed from a paper feeding tray 107 when image information is transferred from an external device to the image forming apparatus 100. The recording material P fed from the paper feeding tray 107 is conveyed to the image forming portion 104 by a contact portion (conveying nip portion) between a conveying roller and a roller which is disposed so as to face the conveying roller. A photosensitive drum 110, which is rotatably shaft-supported in the image forming portion 104, is uniformly charged by a charging roller 108 which is also rotatable, and based on this image information, a latent image is formed by a laser beam emitted from the laser scanner unit 103. While the photosensitive drum 110 passes through a position facing a developing sleeve 109 carrying toner, toner adheres to the charged region on the surface of the photosensitive drum 110 by bias that is applied between the photosensitive drum 110 and the developing sleeve 109, whereby a toner image is formed. The toner image formed on the charged regions on the surface of the photosensitive drum 110 is transferred to the recording material P by the transfer bias applied between the photosensitive drum 110 and the transfer roller 111 when the recording material P passes through a transfer nip portion N2 formed by the photosensitive drum 110 and the transfer roller 111. The toner image carried on the recording material P becomes a fixed image by the heat and the pressure applied in the fixing device 105. Then the recording material P is sent to a discharging roller 119 by the conveying force of the fixing device 105, and is discharged to the discharging portion of the image forming apparatus 100 by the discharging roller 119 (arrow M direction in FIG. 1), thereby a sequence of the image forming procedure ends.

Figure 2A:
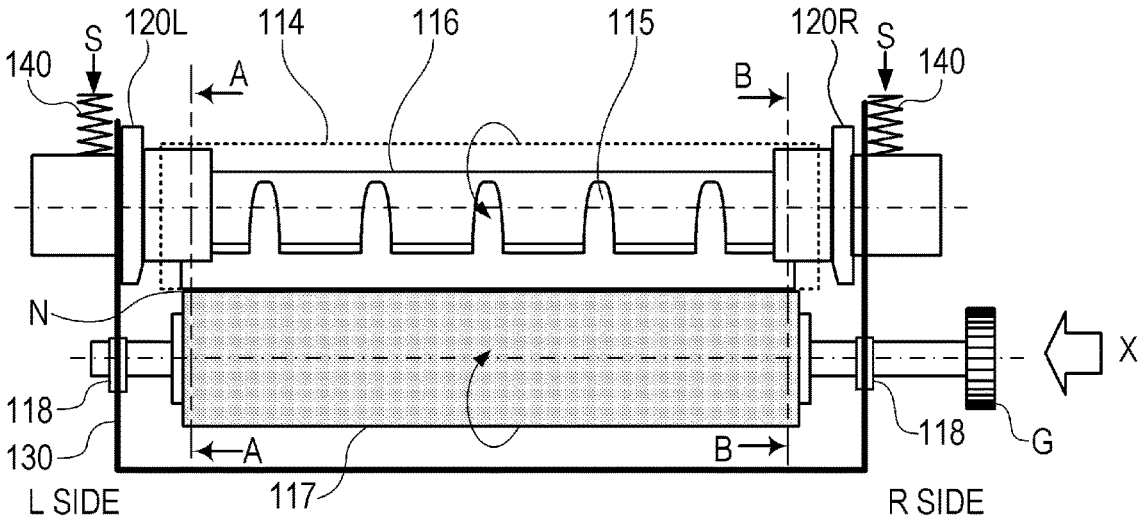
FIGS. 2A and 2B are diagrams depicting a configuration of the fixing device according to Embodiment 1.
Figure 2B:
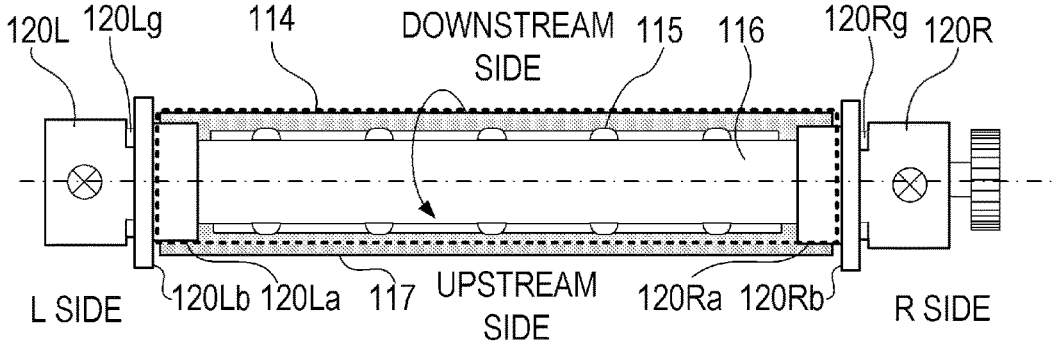

The fixing device 105 of the present embodiment illustrated in FIGS. 2A and 2B is a film heating type fixing device, and this configuration will be described later in detail. The fixing processing by the fixing device 105 (fixing portion) will be performed as follows. A pressure roller 117 rotates in the arrow direction in FIG. 2A when a driving gear G, disposed on an edge portion of a core metal 117*a* of the pressure roller 117, is rotatably driven by a motor (not illustrated). When the pressure roller 117 rotates, a rotating force is applied to a fixing film 114 by a friction force between an outer peripheral surface of the pressure roller 117 and the outer peripheral surface of the fixing film 114 generated in the fixing nip portion N. By the rotation of the pressure roller 117, the inner surface of the fixing film 114 slides against a heater 112, and in this state the fixing film 114 rotates in the arrow direction while the inner surface is guided by a film guide 115. The film guide 115 holds a heater 112. A backup member, which is disposed in the internal space of the fixing film 114 of the fixing device 105 of this embodiment, includes the film guide 115 and the heater 112.

Heat resistant grease is applied between the fixing film 114 and the heater 112, and between the fixing film 114 and the film guide 115. The heat resistant grease used here is a fluorine-based grease containing perfluoropolyether used as a base oil, and polytetrafluoroethylene (PTFE) used as a thickener.

Figure 3:
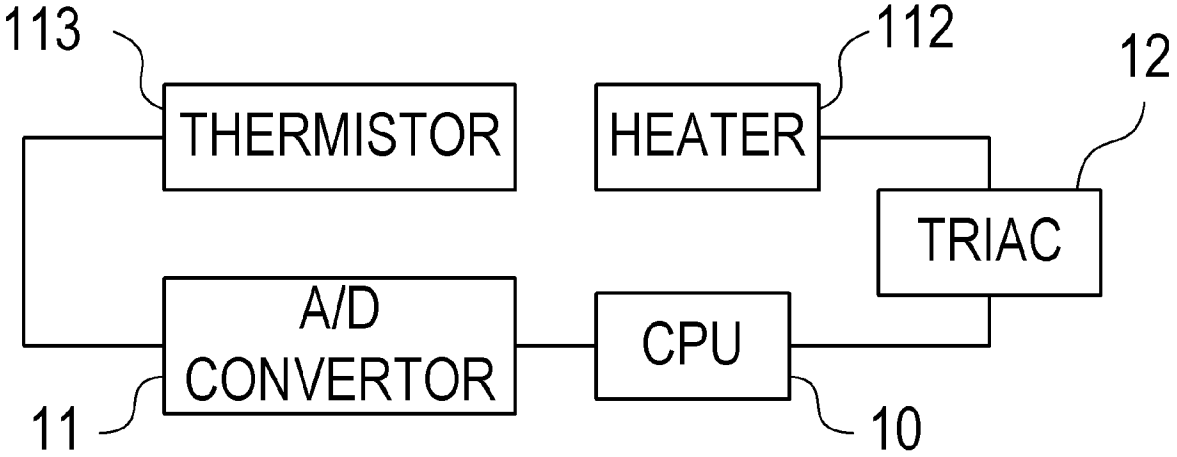
FIG. 3 is a block diagram depicting a temperature control system of the image forming apparatus according to Embodiment 1.

When a CPU 10 indicated in FIG. 3 turns a triac 12 (energizing control portion) ON, power is supplied to an electric resistant layer formed on the surface of the heater 112, whereby the heater 112 is heated and temperature thereof rises. The temperature of the heater 112 is detected as an output signal (temperature detection signal) of a thermistor 113 (see FIGS. 9A and 9B) disposed on the rear face of the heater 112, and is sent to the CPU 10 via an A/D convertor 11. Based on the temperature detection signal, the CPU 10 controls the power supplied to the heater 112 using the triac 12, based on phase control, wave number control, or the like, so as to control the power of the heater 112. The triac 12 is controlled such that the temperature of the heater 112 is increased if the temperature of the heater 112 is lower than a predetermined preset temperature (target temperature), and the temperature of the heater 112 is decreased if it is higher than the preset temperature, whereby the heater 112 is maintained as the preset temperature.

When the temperature of the heater 112 rises to the preset temperature and the rotation speed of the fixing film 114 caused by rotation of the pressure roller 117 is stabilized, the recording material P carrying an unfixed toner image is introduced to the fixing nip portion N. This recording material P is held between the fixing film 114 and the pressure roller 117 in the fixing nip portion N, and is conveyed in this state. In this conveying procedure, the heat of the heater 112 is transferred to the unfixed toner image on the recording material P via the fixing film 114, and pressure is applied to the unfixed toner image on the recording material P by the nip portion, thereby the unfixed toner image is heated and fixed to the surface of the recording material P.

(3) Fixing Apparatus 105

A detailed configuration of the fixing device 105, which is the image heating device according to the present embodiment, will be described with reference to FIGS. 2A to 5B. The fixing device 105 of the present embodiment is a film heating type fixing device aiming at decreasing the rise time and reducing the power consumption to increase speed and prolong life. FIGS. 2A and 2B are diagrams depicting the configuration of the fixing device 105. FIG. 2A is a view of the fixing device 105 from the upstream side of the conveying direction of the recording material, and FIG. 2B is a view of the fixing device 105 from the fixing film 114 side, in the direction orthogonal with both the rotation axis direction of the pressure roller 117 and the recording material conveying direction. In FIGS. 2A and 2B, in order to see the state inside the fixing device 105 through the fixing film 114, the outline of the fixing film 114 is indicated by the broken line, and the components disposed inside the fixing film 114 are indicated by the solid line.

The fixing device 105 includes: the tubular fixing film 114; a plate type heater 112 (see FIGS. 9A and 9B) which contacts the inner surface of the fixing film 114 and also plays a role of a nip portion forming member; and a pressure roller 117 which forms the nip portion N along with the heater 112 via the fixing film 114. The fixing device 105 further includes: a pressure spring 140 which is a pressing mechanism; and a support sheet metal (frame) 130 that rotatably supports the pressure roller 117. Hereafter the direction of the rotation axis of the pressure roller 117 is referred to as a rotation axis direction. The rotation axis direction is parallel with the width direction of the recording material, which is orthogonal with the conveying direction of the recording material P. In the present embodiment, the fixing film 114, the heater 112 and the pressure roller 117 are members that are long in the rotation axis direction. The fixing device 105 also includes a stay 116, which reinforces the film guide 115 by enhancing the bending rigidity. The longitudinal direction of the stay 116 is parallel with the rotation axis direction. The flanges 120L and 120R are disposed on both edge portions of the stay 116. When the pressing force S of the pressure spring 140 is applied to the flanges 120L and 120R, the stay 116, the film guide 115 and the heater 112 move together along a later mentioned guide surface 130*a* of the support sheet metal 130.

Individual components will be described in detail next. The heater 112 includes a substrate, a heating resistance layer and a protective layer. The substrate is a member having good thermal conductivity, high heat resistant, and insulation properties, such as alumina and aluminum nitride. The heating resistance layer is formed on the surface of the substrate by screen printing or the like, to be about a 10 [μm] thickness and 1 to 3 [mm] width. A material used for the heating resistant layer is Ag/Pd (silver palladium), for example. The protective layer is a layer formed on the heating resistant layer, and is formed of glass, fluororesin, or the like. A thermistor 113 (a temperature detecting unit) is disposed on the rear face of the heater 112. As illustrated in FIG. 3, this thermistor 113 is connected to the CPU 10 (a temperature control unit) via an A/D convertor 11.

Figure 4A:
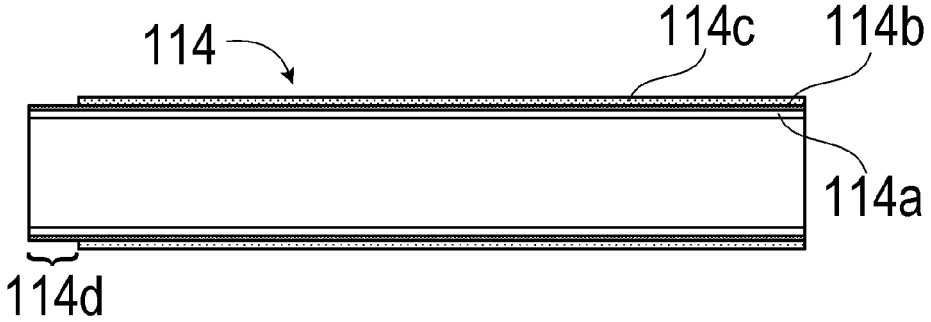
FIGS. 4A to 4C are diagrams depicting details on the composing members of the fixing device according to Embodiment 1.

The fixing film 114 is externally fitted to the heater 112 and the film guide 115 such that the inner periphery of the fixing film 114 is slightly longer than the outer periphery of the heater 112 and the film guide 115. Therefore the fixing film 114 rotates in a state where the inner peripheral surface thereof is guided by the heater 112 and the film guide 115. FIG. 4A is a schematic diagram depicting a layer configuration of the fixing film 114. The fixing film 114 has a multi-layered configuration in the thickness direction, and includes a substrate 114*a* constituted of a 20 to 100 [μm] polyimide resin, and a conductive primer layer 114*b* formed on the substrate. The fixing film 114 also includes a release layer 114*c*, which is formed on the conductive primer layer 114*b* and is constituted of such fluororesin as PFA, PTFE or FEP. The release layer 114*c* is an outermost layer of the fixing film 114, and contacts with the pressure roller 117 to form the nip portion N. A conductive layer exposed portion 114*d*, where the conductive primer layer 114*b* is exposed, is formed on one edge portion of the fixing film 114. The conductive layer exposed portion 114*d* is disposed via a conductive rubber band (not illustrated), and is used to stabilize the film potential. In the present embodiment, a film, of which outer diameter is 18.0 [mm] and total film thickness is 64 [μm], is used for the fixing film 114.

Figure 4B:
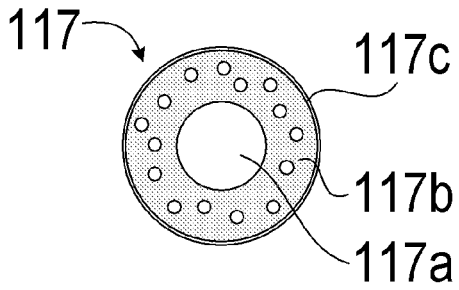

FIG. 4B is a view of the pressure roller 117 in the rotation axis direction. The pressure roller 117 includes the core metal (shaft of roller) 117*a*, a heat resistant elastic layer 117*b* formed around the core metal 117*a*, and a release layer 117*c* formed on the elastic layer 117*b*. A material of the elastic layer 117*b* is silicon rubber. The core metal 117*a* is φ8.5 [mm], and is formed of such metal as SUS. The pressure roller 117 used for the present embodiment is a pressure roller having such a characteristic that the volume of the elastic layer decreases by compression. Specifically, a pressure roller having such a characteristic is, for example, a roller of which elastic layer is formed by a sponge rubber containing continuous air bubbles, or a rubber containing a high percentage of independent air bubbles. In the present embodiment, the pressure roller 117 includes the elastic layer 117*b* formed of continuous foam sponge rubber, in which air bubbles are contiguous with adjacent air bubbles. The release layer 117*c* formed of such fluororesin as PFA, PTFE or FEP is disposed on the outer periphery of the elastic layer 117*b*. In the present embodiment, the pressure roller 117 is a roller of which outer diameter is 14.0 [mm] and hardness is 47° (Asker-C: 600 g load). The pressure roller 117 is rotatably supported by the support sheet metal 130 via the bearing 118.

A film guide 115 illustrated in FIGS. 2A and 2B also has a function to support the heater 112 from the surface on the side opposite of the surface contacting with the fixing film 114 of the heater 112. The film guide 115 also extends along the inner peripheral surface of the fixing film 114, and guides, along with the heater 112, the rotational movement of the fixing film 114.

Figure 4C:
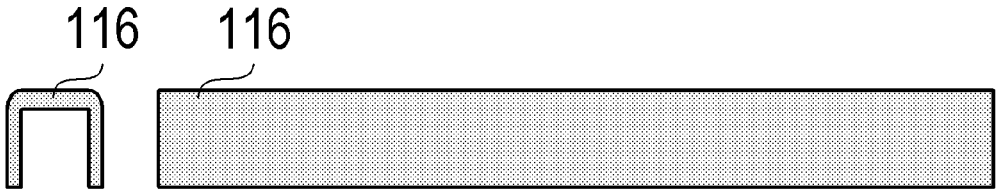

FIG. 4C is a diagram depicting the stay 116. The stay 116, used as a reinforcing member for enhancing bending rigidity of the film guide 115, which is a component molded with a heat resistant resin, is long in the rotation axis direction of the pressure roller 117. The cross-section of the stay 116 in the direction orthogonal with the rotation axis direction of the pressure roller 117 is U-shaped. In the view in the rotation axis direction of the pressure roller 117, the stay 116 is disposed in an orientation such that the opening portion of the U shape faces the heater 112. As illustrated in FIGS. 2A and 2B, the stay 116 is engaged with the flanges 120L and 120R respectively, and receives the pressing force S from the pressure spring 140, which is held by the fixing device 105, via the flanges 120L and 120R. The stay 116 is configured such that the pressing force S is applied to the recording material conveying surface in an approximate vertical direction. The pressing force S transferred to the stay 116 is transferred to the heater 112 via the film guide 115. In other words, by the urging force from the pressure spring 140, the fixing film 114, which is externally fitted to the heater 112 and the film guide 115, is urged toward the pressure roller side, and forms a uniform nip portion N between the heater 112 and the pressure roller 117 in the longitudinal direction via the fixing film 114.

The flange 120R includes a rotation guide portion 120Ra which guides the inner peripheral surface of the fixing film 114, a regulating portion 120Rb which regulates the shift of the fixing film 114 in the longitudinal direction thereof, and a groove portion 120Rg which slides against the guide surface 130*a* of the support sheet metal 130. The outer peripheral surface of the rotation guide portion 120Ra is formed to be curved along the inner peripheral surface of the fixing film 114, and extends out from the regulating portion 120Rb. The rotation guide portion 120Ra is fitted with the fixing film 114, and guides, along with the film guide 115, the inner peripheral surface of the rotating fixing film 114. The groove portion 120Rg is disposed inclined at an angle matching with the inclination angle of the guide surface 130*a*, so as to match with the guide surface 130*a*, which will be described in detail later. The flange 120L has the same configuration as the flange 120R, and includes a rotation guide portion 120La, a regulating portion 120Lb and a groove portion 120Lg. In other words, the flanges 120R and 120L are disposed to face both ends of the fixing film 114 respectively, and not only regulate the shift of the fixing film 114 in the longitudinal direction as regulating members, but also guide the rotation of the fixing film 114. Hereafter, the subscripts R and L are omitted unless a distinction between the flanges 120R and 120L is necessary.

The support sheet metal 130 is a 1.2 mm thick sheet metal, and supports the pressure roller 117 via the bearing 118. The shaft of the pressure roller 117 is inserted into the bearing 118. The support sheet metal 130 also includes the guide surface (guide portion) 130*a*, to guide the shift of the flange 120 in the case where the flange 120 receives the pressing force S from the pressure spring 140. The guide surface 130*a* of the present embodiment is a plane, and as illustrated in FIG. 2B, the groove 120*g* engages with the support sheet metal 130, thereby the flange 120 can move along the guide surface 130*a* of the support sheet metal 130. The guide surface 130*a* is formed so as to extend at a 30° inclination with respect to the plane orthogonal with the recording material conveying direction. This means that the guide surface 130*a* is inclined such that the nip portion is formed more on the downstream side in the recording material conveying direction as the volume of the elastic layer 117*b* of the pressure roller 117 decreases. The guide surface 130*a* is disposed respectively on the side plates of the support sheet metal 130 that face each other, and the flange 120 is configured to move more to the downstream side in the recording material conveying direction as the flange 120 closely approaches the pressure roller 117. By the urging force from the pressure spring 140, the flange 120 moves together with the stay 116, the film guide 115 and the heater 112 along the guide surface 130*a*.

Figure 5A:
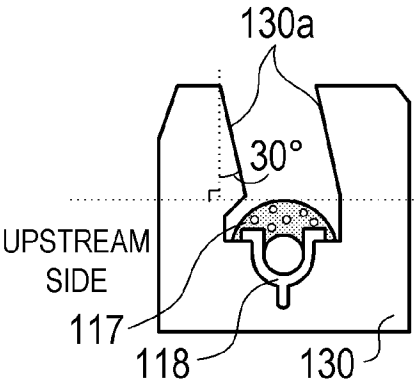
FIGS. 5A and 5B are side views of the fixing device according to Embodiment 1.
Figure 5B:
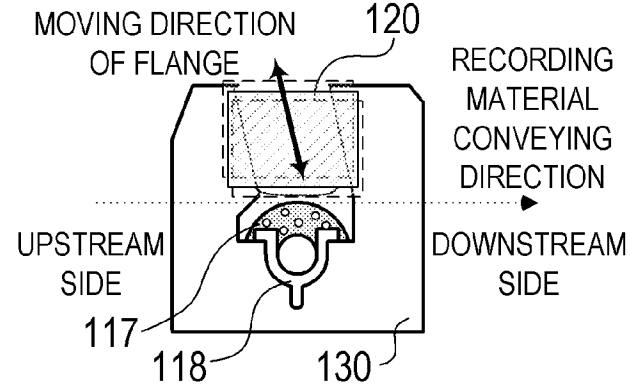

The operation of the flange 120 when the pressing force S is received in the fixing device 105 of the present embodiment will be described in detail. FIGS. 5A and 5B are schematic diagrams of the fixing device 105 of the present embodiment viewed in the rotation axis direction of the pressure roller 117, and indicate the positional relationships and shapes of the pressure roller 117, the bearing 118 and the support sheet metal 130 (viewed in the X arrow direction in FIG. 2A). FIG. 5A indicates a state where only the pressure roller 117 and the bearing 118 are installed in the support sheet metal 130. FIG. 5B is a state where the flange 120 is also installed in the support sheet metal 130, and the flange 120 moves along the guide surface 130*a*. As mentioned above, the guide surface 130*a* of the fixing device 105 of the present embodiment has a 30° inclination with respect to the plane orthogonal with the recording material conveying direction. The guide surface 130*a* was described in the configuration viewed from the side of the flange 120R with reference to FIGS. 5A and 5B, but the guide surface 130*a* is formed in the same way all through the rotation axis direction. In other words, just like the flange 120R, the flange 120L is also configured to engage with the support sheet metal 130 and move along the guide surface 130*a*. Therefore the flange 120 moves more to the downstream side in the conveying direction as well, as the flange 120 receives the pressing force S from the pressure spring 140 and moves closer to the pressure roller 117, or as the pressure roller 117 is compressed more. In other words, in a case where difference is generated in a compression amount of the elastic layer 117*b* of the pressure roller 117 in the rotation axis direction, difference is also generated in the moving amount between the flanges 120L and 120R. The configuration where the guide surface 130*a* is disposed at an angle that is not vertical to the recording material conveying surface is characteristic of the present invention, and contributes to reducing the shifting force, which will be described later.

The present embodiment is configured such that when the pressure roller 117 deforms and the distance between the center axis of the pressure roller 117 and the nip portion N is contracted by a predetermined design value, the center of the heater 112 matches with the rotation axis of the pressure roller 117 in the conveying direction of the recording material P. In other words, even if the pressing force, the hardness of the pressure roller 117 and the like are not exactly the design values, the position of the heater 112 does not deviate very much from the pressure roller 117, and the pressure roller 117 can be appropriately pressed via the fixing film 114.

Figure 7:
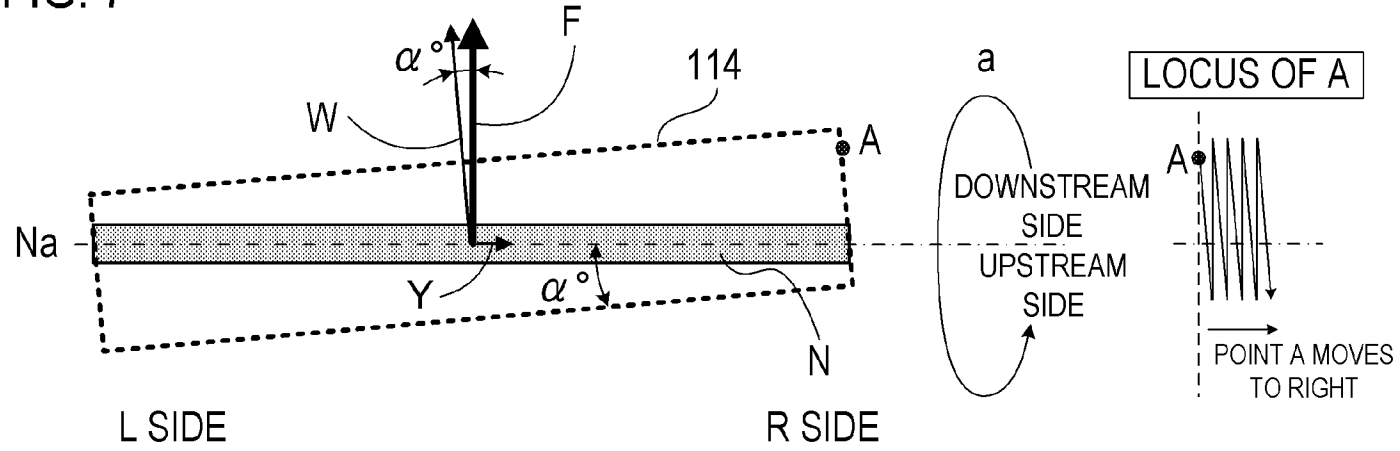
FIG. 7 is a diagram depicting a mechanism of generation of a shift of the fixing film.

(4) Relationship of Crossing Angle of Rotation Axes of Pressure Roller and Fixing Film and Shifting Force A mechanism when a shifting force Y, to move the fixing film 114 in the rotation axis direction in the case where a crossing angle is generated between the rotation axis of the pressure roller 117 and the rotation axis of the fixing film 114, will be described with reference to FIG. 7. FIG. 7 is a diagram when the fixing film 114 (broken line) and the fixing nip portion N are viewed in the direction that is orthogonal with both the rotation axis direction of the pressure roller 117 and the conveying direction of the recording material P. The case where the crossing angle is generated between the rotation axis of the pressure roller 117 and the rotation axis of the fixing film 114 is a case where the rotation axis of the fixing film 114 is not parallel with the rotation axis of the pressure roller 117, but is inclined therefrom. FIG. 7 indicates a case where the rotation axis of the fixing film 114 is inclined from the rotation axis of the pressure roller 117 at inclination angle $\alpha°$, so as the R side (right side in FIG. 7) of the fixing film 114 is located on the downstream side in the conveying direction of the recording material P with respect to the L side (Left side in FIG. 7). Here the rotation axis of the pressure roller 117 is parallel with the nip portion centerline Na, which is the centerline of the nip portion N.

The fixing film 114 is loosely fitted to the film guide 115 from the outside, and by contacting with the rotating pressure roller 117, the fixing film 114 rotates in the arrow a direction, and along with the pressure roller 117, the fixing film 114 conveys the recording material P. In other words, when the fixing film 114 contacts with the rotating pressure roller 117 at the fixing nip portion N, the driving force F is applied to the fixing film 114. As illustrated in FIG. 7, in the case where the fixing film 114 contacts the pressure roller 117 in a state of generating the crossing angle, the driving force F is separated into the rotation force W, which is vertical to the longitudinal direction of the fixing film 114, and the shifting force Y in the rotation axis direction of the pressure roller 117, and is applied to the fixing film 114 in this state. The rotation force W is applied as a force to rotate the fixing film 114, and the shifting force Y is applied as a force to move the fixing film 114 to the R side. If the inclination of the fixing film 114 from the rotation axis direction of the pressure roller 117 in the longitudinal direction is $\alpha°$, then the rotation force W that is applied to the fixing film 114 can be expressed as $F \cos \alpha$, and the shifting force Y can be expressed as $F \sin \alpha$. When the shifting force Y is applied to the fixing film 114, an arbitrary point A at the edge portion of the fixing film 114 in the longitudinal direction moves to the R side while rotating in the path indicated as "Locus of A" at the right in FIG. 7. In this way, in the case where the rotation axis of the pressure roller 117 and the rotation axis of the fixing film 114 are not parallel, the fixing film 114 contacts with the rotating pressure roller 117, whereby not only the rotation force W but the shifting force Y as well is applied to the fixing film 114.

Figure 8A:
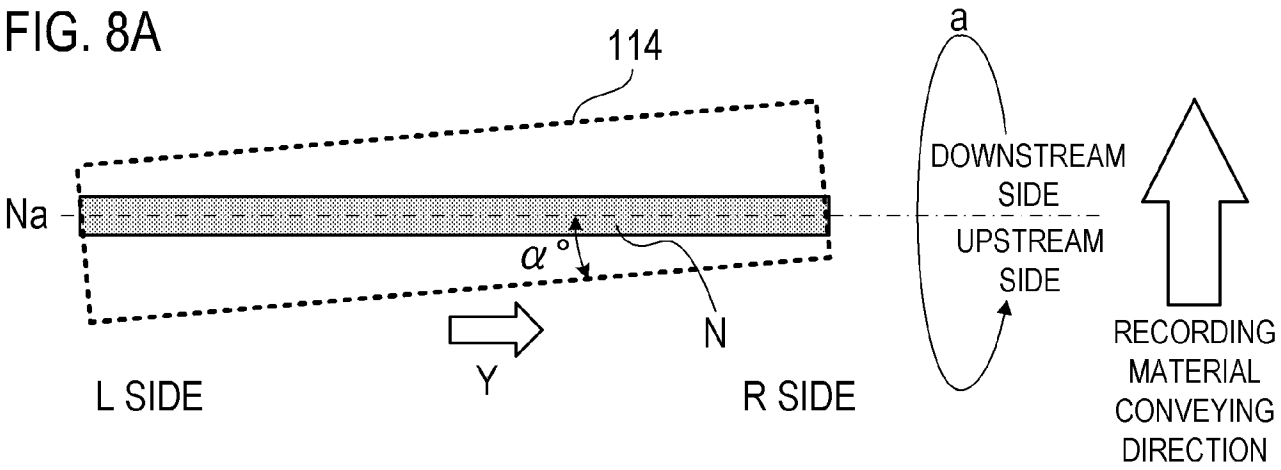
FIGS. 8A and 8B are diagrams depicting the relationship between the inclination of the rotation axis of the fixing film and the shifting force.
Figure 8B:
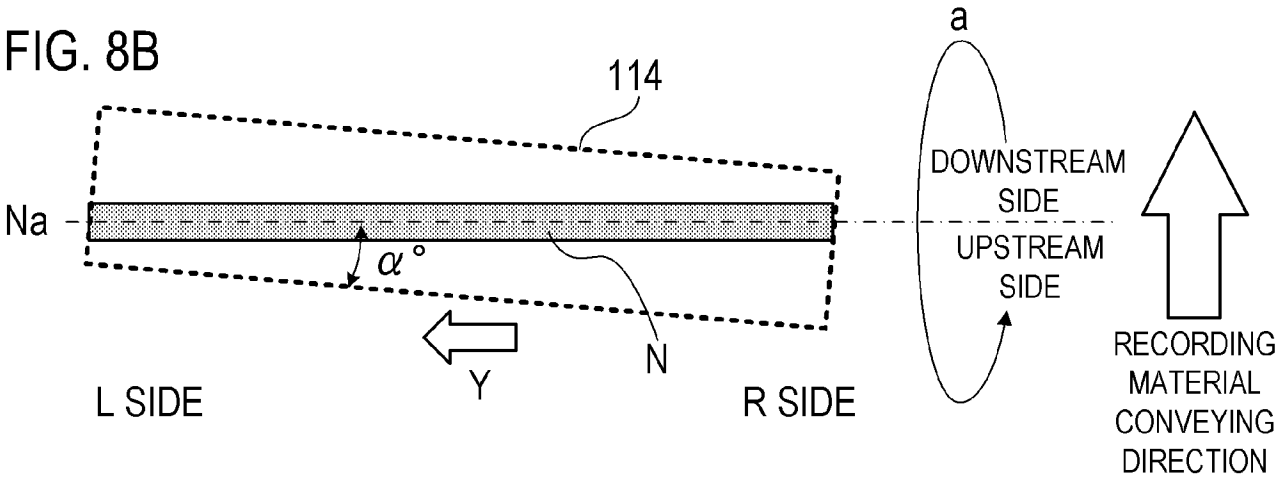

FIGS. 8A and 8B are diagrams depicting a direction where the shifting force Y is generated based on the above mentioned shifting force generation mechanism, depending on the state of the crossing angle generated between the rotation axis of the pressure roller 117 and the rotation axis of the fixing film 114. FIG. 8A indicates a case where the R side of the fixing film 114 relatively locates on the downstream side of the recording material conveying direction compared with the L side, with respect to the rotation axis of the pressure roller 117. In this case, the force to shift the fixing film 114 to the R side is generated based on the above mentioned principle. FIG. 8B, on the other hand, indicates a case where the R side of the fixing film 114 relatively locates on the upstream side of the recording material conveying direction compared with the L side, with respect to the rotation axis of the pressure roller 117. In this case, the shifting force Y, to shift the fixing film 114 to the L side, is generated based on the same principle.

(5) Relationship of Difference of Conveying Speed of Pressure Roller in Longitudinal Direction and Shifting Force The generation of the shifting force Y, caused by the fixing film 114 contacting with the pressure roller 117 in the inclined state, was described above. Now actual cases where the crossing angle is generated between the pressure roller 117 and the fixing film 114, and the shifting force Y is applied to the fixing film 114 thereby, will be described. As an example, a relationship between the difference of the conveying speed of the pressure roller 117 in the longitudinal direction and the shifting force, in the case where the hardness of the pressure roller 117 is not constant in the longitudinal direction, will be described.

Figure 9A:
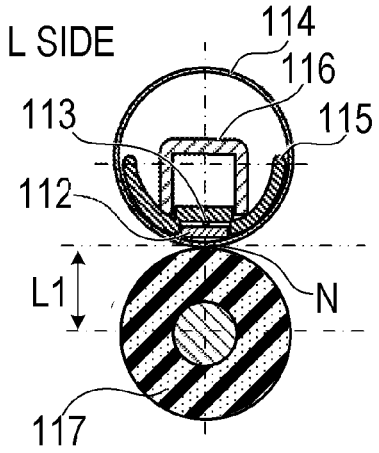
FIGS. 9A and 9B are cross-sectional views of an A-A plane and a B-B plane of the fixing device according to Embodiment 1.
Figure 9B:
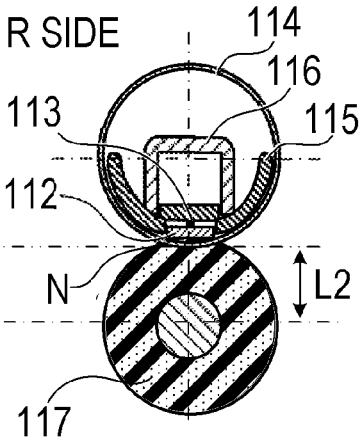

FIGS. 9A and 9B are cross-sectional views depicting the relationship between the fixing film 114 and the pressure roller 117 in the case where the hardness of the pressure roller 117 is different between both ends of the pressure roller 117 in the longitudinal direction. FIG. 9A is an A-A cross-sectional view indicating the left side (L side) when the fixing device 105 illustrated in FIG. 2A is viewed from the upstream side of the recording material conveying direction; and FIG. 9B is a B-B cross-sectional view indicates the right side (R side) thereof. In the present embodiment, the hardness of the pressure roller 117 on the R side illustrated in FIG. 9B is relatively lower than the hardness on the L side illustrated in FIG. 9A. Therefore if the distances from the center of the pressure roller to the fixing nip portion N on the L side and the R side are L1 and L2 respectively, as indicated in FIGS. 9A and 9B, L1 is longer the L2 (L1>L2), since the R side, of which hardness of the pressure roller 117 is lower, is more compressed. In the case of the pressure roller 117 used in the present embodiment, the elastic layer 117*b* is formed of a continuous foaming sponge rubber, hence if the pressure roller 117 is pressed and compressed, the air inside the bubbles existing in the elastic layer 117*b* is released, and the bubble collapse, that is, the elastic layer 117*b* deform and the outer peripheral length becomes smaller. If the pressure roller 117 is rotated in this state, the rotation frequency is the same in the R side and the L side but the outer peripheral lengths thereof are different, hence the circumferential speed as well as the conveying speed become different between the R side and the L side. The conveying speed becomes relatively slower in the R side than the L side, since the L side rotates with rotation radius L1 and the R side rotates with rotation radius L2, which is shorter than L1.

Figure 10A:
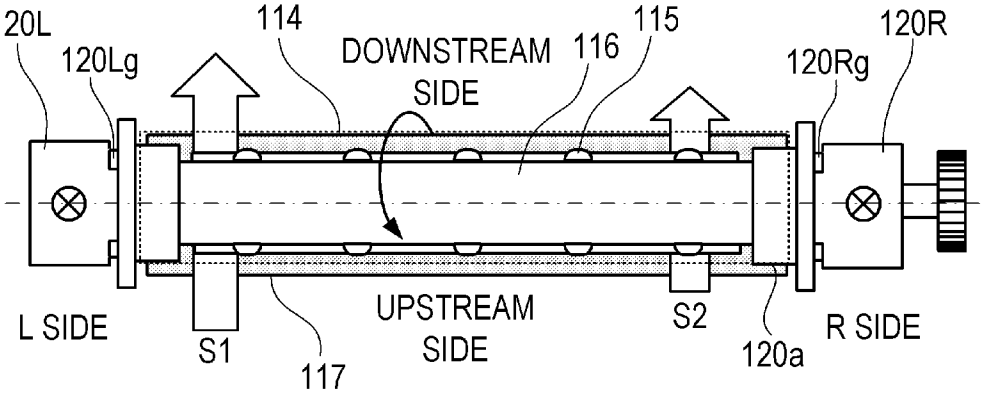
FIGS. 10A and 10B are diagrams depicting the relationship between the conveying speed difference in a pressure roller in the longitudinal direction and the shifting force.
Figure 10B:
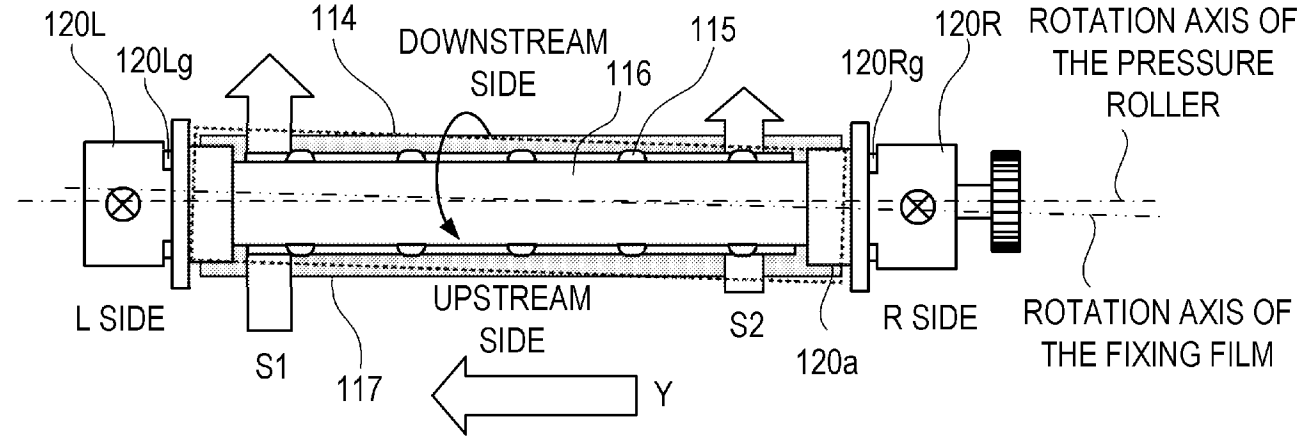

FIGS. 10A and 10B are diagrams depicting the shifting force generation direction in the case where difference is generated in the hardness of the pressure roller in the rotation axis direction. As mentioned above, the conveying speed S2 on the R side is slower than the conveying speed S1 on the L side, since the hardness of the pressure roller on the R side is lower than the L side, as indicated in FIG. 10A. If the fixing film 114, which is disposed parallel with the pressure roller 117, contacts with the pressure roller 117 in this state, the rotation axis of the fixing film 114 is inclined such that the L side, of which conveying speed is faster, moves to the relatively downstream side in the conveying direction, as indicated in FIG. 10B. Then the fixing film 114 continues rotating in the state where the crossing angle is generated between the rotation axis of the pressure roller 117 and the rotation axis of the fixing film 114. As a result, the shifting force to the L side is generated based on the principle described in the above mentioned (4). In this way, when the hardness of the pressure roller is different in the rotation axis direction, the crossing angle is generated between the rotation axis of the fixing film 114 and the rotation axis of the pressure roller 117, and the shifting force Y is applied to the fixing film 114. Furthermore, in the case where the pressing force S is different between the L side and the R side, or in the case where the outer peripheral length of the fixing film 114 is different between the L side and the R side as well, the conveying speed may become different in the longitudinal direction. In other words, in an actual fixing device, the shifting force is generated in either direction, since a crossing angle is generated between the rotation axis of the fixing film 114 and the rotation axis of the pressure roller 117 in either direction L or R due to component tolerance and the like.

(6) Principle of Reducing Shifting Force

A mechanism of reducing the shifting force in the fixing device of the present embodiment will be described. This mechanism will be described based on the comparison with a fixing device of a comparative example in FIGS. 6A and 6B, which does not include the shifting force reducing mechanism. The pressure roller 117 used here is a pressure roller of which pressure roller hardness is different in the longitudinal direction, that is 48.0° on the L side, 47.0° at the center, and 45.0° on the R side (Asker C: 600 g load). In this case, for both the fixing device of the present embodiment and the fixing device of the comparative example, the radius of the pressure roller 117 (distance between the rotation center of the pressure roller and the heater surface) is 6.57 mm (L1) on the L side, and 6.29 mm (L2) on the R side. The radius influences the peripheral length and therefore influences the conveying speed, hence the fixing film 114 is rotated at the conveying speed, which is 4.45% faster on the L side than on the R side.

Figure 6A:
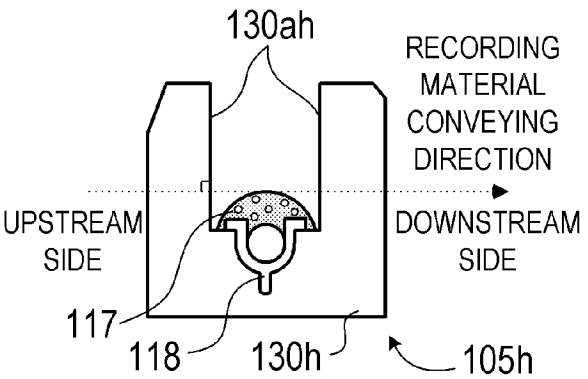
FIG. 6A PRIOR ART
FIGS. 6A and 6B are side views of a fixing device according to a comparative example.
Figure 6B:
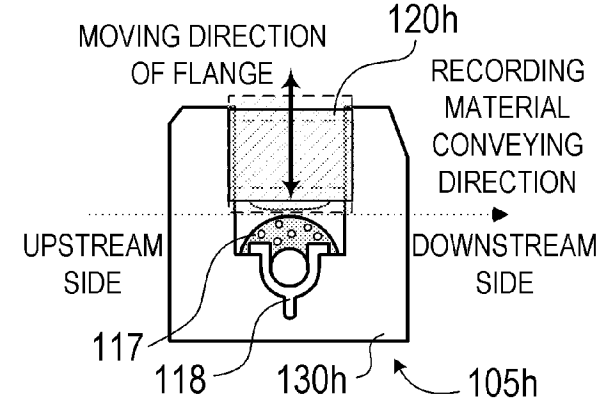
FIG. 6B PRIOR ART

Configuration of Fixing Apparatus of Comparative Example and Shifting Force Generation State The only difference between the fixing device of the comparative example and the fixing device of the present embodiment is the shapes of the support sheet metals 130 and 130*h* constituting the respective fixing devices, and the shapes of the flanges that fit with the support sheet metals 130 and 130*h*. FIGS. 6A and 6B indicate the positional relationship and the shapes of the pressure roller 117, the bearing 118 and the support sheet metal 130*h* of the fixing device 105*h* of the comparative example when viewed in the rotation axis direction of the pressure roller 117 (viewed in the X arrow direction in FIG. 2A). The support sheet metal 130*h* of the fixing device of the comparative example is formed in a conventional way, that is, the guide surface 130*ah* is formed vertical to the recording material conveying surface, and a groove is formed in the flange 120*h* so as to correspond to the shape of the guide surface ah. In other words, the flange 120*h* is held by the support sheet metal 130*h* so as to move approximately vertically to the recording material conveying surface. If the conveying speed becomes different in the rotation axis direction in the apparatus having such a configuration, the crossing angle is generated between the rotation axis of the pressure roller 117 and the rotation axis of the fixing film 114, as illustrated in FIG. 8B, and the shifting force is generated only toward the L side.

Shifting Force Generation State in Fixing Apparatus of Present Embodiment

In the case of the fixing device of the present embodiment as well, the conveying speed becomes different in the longitudinal direction because of the hardness difference in the pressure roller 117, hence the shifting force to the L side is generated in the fixing film 114, just like the fixing device of the comparative example (FIG. 8B). On the other hand, it is a characteristic of the support sheet metal 130 of the present embodiment that the flange 120 is moved the downstream side of the recording material conveying direction if the pressure roller 117 is compressed, as indicated in FIG. 5B, and the shifting force applied to the fixing film 114 is reduced by this configuration. This reduction mechanism will now be described.

In the fixing device of the present embodiment, if the above mentioned pressure roller 117 having the hardness difference in the longitudinal direction is used, the R side is more compressed than the L side by 0.28 mm (that is, 6.57 mm-6.29 mm). The guide surface 130*a* of the support sheet metal 130 of the present embodiment is 30° inclined from the pressing direction, and the flange 120 moves along the guide surface 130*a*. Therefore compared with the L side, the R side of the fixing film 114 locates on the center axis side of the pressure roller 117 by 0.28 mm in the direction orthogonal with the conveying direction, and locates more to the downstream side of the recording material conveying direction by 0.16 mm. The distance between the R side and the L side of the fixing film 114 in the recording material conveying direction here is calculated as: 0.16 mm=0.28 mm×sin (90°−30°)/cos (90°−30°). Here the R side of the fixing film locates on the downstream side of the recording material conveying direction, which means that the fixing film 114 and the pressure roller 117 have the crossing angle in the direction indicated in FIG. 8A, hence the shifting force to the R side is generated, as described in the above (4). As described above, in the fixing device of the present embodiment, the shifting force to the L side is generated due to the conveying speed difference of the pressure roller 117 in the longitudinal direction, but at the same time, the shifting force to the R side is generated, hence in total the shifting force becomes smaller than the shifting force of the fixing device of the comparative example. In other words, in the fixing device of the present embodiment, the guide surface 130*a* is configured such that the shifting force is generated in the direction that cancels out the shifting force generated due to the hardness difference of the pressure roller 117, therefore the shifting force can be reduced.

(7) Effect Verification Result Based on Durability Test

In order to confirm the shifting force reducing effect of the present invention, a paper passing durability test was performed using the fixing device of the present embodiment and the fixing device of the comparative example. The pressure roller used here is a pressure roller of which pressure roller hardness difference in the longitudinal direction is 48.0° on the L side, 47.0° at the center, and 45.0° on the R side (Asker C: 600 g load). The pressure spring used for the durability test has a configuration where the spring constant on the R side is 120%, and 100% on the L side, that is, the pressure roller is compressed more on the R side. In the paper passing durability test, 1,000,000 sheets of A4 sized 80 g/m$^2$ paper were passed, and the state of the fixing film 114 was checked every time a predetermined number of sheets of paper are passed.

Table 1 Number of Passed Sheets of Paper, and State of Fixing Film 114 at This Timing Table 1 indicates a number of passed sheets of paper when the fixing film 114 was checked, and the state of the fixing film 114 at this timing.

| Number of durable sheets | Comparative example | Embodiment 1 |
|---|---|---|
| 0 | No Abnormality | No Abnormality |
| 50,000 | No Abnormality | No Abnormality |
| 100,000 | No Abnormality | No Abnormality |
| 200,000 | No Abnormality | No Abnormality |
| 250,000 | No Abnormality | No Abnormality |
| 500,000 | No Abnormality | No Abnormality |
| 750,000 | Minor Bending | No Abnormality |
| 1,000,000 | Minor Bending | No Abnormality |

In the evaluation result, the states in the table indicate the following evaluation result.

No Abnormality: no abnormality on the edge portion of the fixing film

Minor Bending: minor bending is generated on the edge portion of the fixing film In the case of the fixing device of the comparative example, minor bending was observed on the L side of the fixing film in checking after passing 750,000 sheets of paper. In the case of the fixing device of the present embodiment, no damage was observed on the edge portion of the fixing film, even after passing 1,000,000 sheets of paper. This indicates that compared with the conventional fixing device of the comparative example, the shifting force on the fixing film 114 is reduced in the fixing device of the present embodiment, and the film edge portion is damaged less in this configured.

As described above, the shifting force that is generated by the generation of the crossing angle, so that the fixing film 114 is inclined from the pressure roller 117, can be reduced by the configuration of the present embodiment that moves the flange in the direction to autonomously cancel out the crossing angle. In other words, the life of the fixing device can be extended in the case where the crossing angle is generated between the pressure roller 117 and the fixing film 114 due to the hardness difference of the pressure roller 117 in the rotation axis direction or the lateral difference of the pressure spring.

The angle of the guide surface of the support sheet metal with respect to the direction orthogonal to the recording material conveying surface is set to 30° in the present embodiment, but the present invention is not limited to this, and the angle may be appropriately adjusted in accordance with the pressing force of the fixing device, the outer diameter and the hardness of the pressure roller, the outer diameter of the fixing film, or the like, to which the present invention is applied. Particularly, if the angle formed by the guide surface and a plane orthogonal with the recording material conveying direction is set to a range that is at least 5° and not more than 45°, in accordance with the dimensions and materials of the various components, then the shifting force reducing effect can be more effectively implemented.

Embodiment 2

Embodiment 2 in which the material of the elastic layer is changed will be described next. The pressure roller used in Embodiment 2 is a pressure roller using a material of which volumes does not change by compression for the elastic layer. Specifically, a material having such as characteristic is, for example, solid rubber, or a rubber that contains a low percentage of air bubbles. The present embodiment is a fixing device including a pressure roller which uses solid rubber for the elastic layer. The pressure roller has a hardness difference in the rotation axis direction, just like Embodiment 1, and the hardness thereof is 48.0° on the L side, 47.0° at the center, and 45.0° on the R side (Asker-C: 600 g load). The view of the fixing device of Embodiment 2 from the upstream side of the recording material conveying direction is the same as Embodiment 1 (see FIG. 2A). Now a configuration and mechanism to reduce the shifting force of Embodiment 2, which was solid rubber for the elastic layer, will be described. The same composing element as Embodiment 1 is denoted with a same reference sign, and description thereof is omitted, and differences from Embodiment 1 will be mainly described.

Figure 11A:
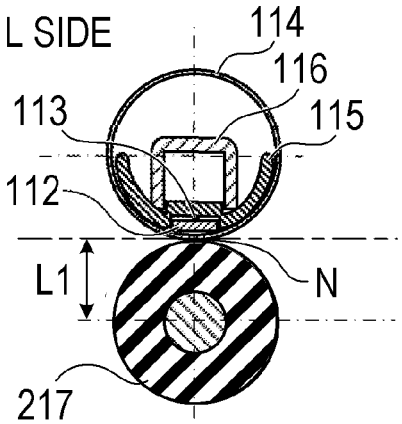
FIGS. 11A and 11B are cross-sectional views of an A-A plane and a B-B plane of a fixing device according to Embodiment 2.
Figure 11B:
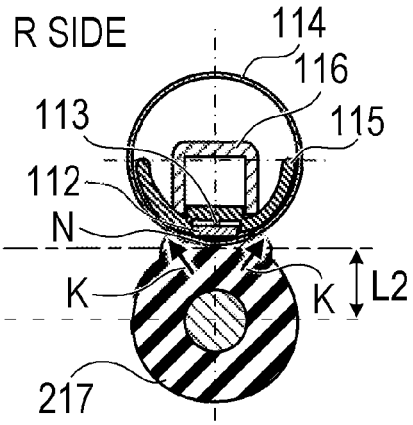

FIGS. 11A and 11B are cross-sectional views depicting the fixing device of Embodiment 2 (fixing device including a pressure roller 217 which uses solid rubber for the elastic layer), and just like Embodiment 1, the A-A cross-sectional view indicates the L side, and the B-B cross-sectional view indicates the R side. As illustrated in FIGS. 11A and 11B, if the distances from the center of the pressure roller 217 to the fixing nip portion N on the L side and the R side are L1 and L2 respectively, then L1 is longer than L2 (L1>L2) since the side of which hardness is lower is more compressed and squashed.

In the case of the pressure roller 217 which uses solid rubber for the elastic layer, if the rubber is compressed, the rubber deforms so as to stretch in the arrow K direction indicated in FIG. 11B, without changing the volume. Therefore as rubber is compressed more, the length in the arrow K direction increases and the outer peripheral length of the pressure roller 217 increases, that is, the conveying speed of the recording material becomes faster. Therefore if the roller that is used has an elastic layer formed of solid rubber and has the above mentioned hardness, the state illustrated in FIG. 8A occurs based on the principle described in (5) of Embodiment 1, and the shifting force to the R side is generated in the fixing film 114. In Embodiment 2 as well, a flange 220 is shifted in the recording material conveying direction in accordance with the compressed amount of the pressure roller 217, so as to cancel out the shifting force.

Figure 12A:
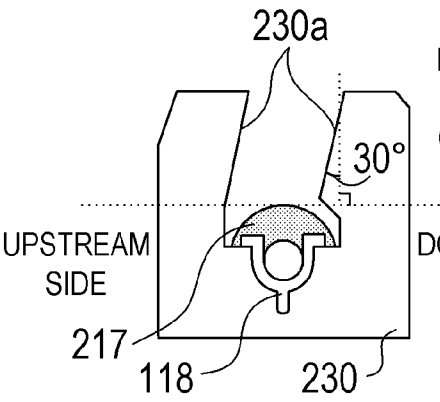
FIGS. 12A and 12B are side views of the fixing device according to Embodiment 2.
Figure 12B:
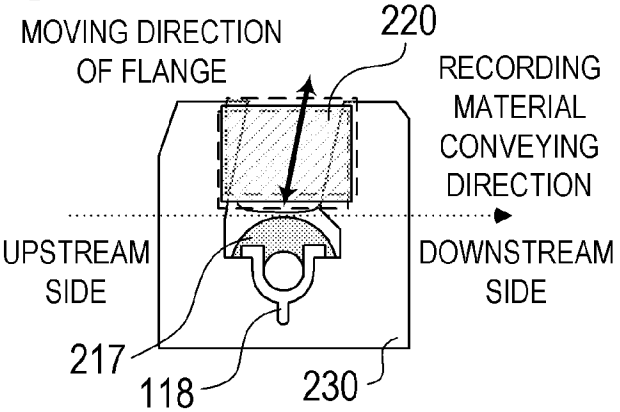

FIGS. 12A and 12B are diagrams depicting the fixing device of Embodiment 2, where the positional relationship and each shape of the pressure roller 217, the bearing 118 and a support sheet metal 230 viewed in the rotation axis direction of the pressure roller 217 are illustrated. Just like Embodiment 1, the guide surface 230*a* of the support sheet metal 230 is inclined from the plane orthogonal with the recording material conveying direction by 30°, but this inclining direction is the opposite of Embodiment 1. In other words, the guide surface 230*a* is inclined such that the nip portion N is formed more to the upstream side of the recording material conveying direction as the film guide 115 approaches the pressure roller 217. In other words, in this configuration, the flange 220 moves more to the upstream side in the conveying direction as the flange 220 receives the pressing force S from the pressure spring 140 and approaches the pressure roller 217, or as the pressure roller 217 is compressed more. In Embodiment 2, the R side of the pressure roller 217 is more compressed, hence as illustrated in FIG. 8B, the fixing film 114 moves such that the R side locates more to the downstream side in the conveying direction than the L side. Here the shifting force is generated to move the fixing film to the L side, therefore the shifting force to the R side generated by the conveying speed difference is decreased. By this configuration, even in the case where the elastic layer is formed of solid rubber or the like, the generation of a strong shifting force to the fixing film 114 can be prevented, just like Embodiment 1, and the life of the fixing device can be prolonged.

Modifications

While the preferred embodiments of the present invention have been described, the present invention is not limited to these embodiments, but may be modified and changed in various ways within the scope of the spirit of the invention thereof. For example, in the case where the hardness of the roller in the rotation axis direction is known in advance, the left and right guide surfaces orthogonal with the recording material conveying surface may be disposed at shifted positions, so that the shifting force is generated in the direction that cancels out the shifting force generated by the conveying speed difference of the material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-097422, filed on Jun. 10, 2021, which is hereby incorporated by reference herein in its entirety.

What is claimed is:

1. An image heating device that heats a recording material on which an image is formed, while conveying the recording material, so as to heat the image in a nip portion, comprising:
- a rotatable tubular film;
- a heater that heats the film;
- a rotatable roller that contacts an outer peripheral surface of the film, and forms the nip portion with the film, to convey the recording material;
- a backup member that is disposed in an internal space of the film all through a longitudinal direction of the film, and supports an inner peripheral surface of the film;
- regulating members that are disposed to face both ends of the film in the longitudinal direction respectively, so as to regulate a movement of the film in the longitudinal direction, and to move along with the backup member;
- a frame of the apparatus, that includes a guide portion to insert the regulating members and a shaft of the roller; and
- a pressing mechanism that applies force to the regulating members so as to apply pressure to the nip portion, wherein
- the roller includes an elastic layer that is deformed by being pressed from a side which the film is placed, such that a distance between a rotation axis of the roller and the nip portion decreases and that a volume of the elastic layer decreases, wherein
- the guide portion guides so that the regulating members move more to a downstream side in a conveying direction of the recording material as the regulating members approach the rotation axis of the roller.

2. The image heating device according to claim 1, wherein the elastic layer is formed of a sponge rubber including air bubbles.

3. The image heating device according to claim 1, wherein the guide portion includes a guide surface that is inclined with respect to a plane orthogonal with the conveying direction, so that the nip portion is formed more to the downstream side in the conveying direction as the volume of the elastic layer decreases.

4. The image heating device according to claim 3, wherein the angle formed by the guide surface and the surface orthogonal with the conveying direction is at least 5° and not more than 45°.

5. The image heating device according to claim 1, wherein the heater is disposed on the backup member.

6. An image heating device that heats a recording material on which an image is formed, while conveying the recording material, so as to heat the image in a nip portion, comprising:
- a rotatable tubular film;
- a heater that heats the film;
- a rotatable roller that contact an outer peripheral surface of the film, and forms the nip portion with the film, to convey the recording material;
- a backup member that is disposed in an internal space of the film all through a longitudinal direction of the film, and supports an inner peripheral surface of the film;
- regulating members that are disposed to face both ends of the film in the longitudinal direction respectively, so as to regulate a movement of the film in the longitudinal direction, and to move along with the backup member;
- a frame of the apparatus, that includes a guide portion to insert the regulating members and a shaft of the roller; and
- a pressing mechanism that applies force on the regulating members so as to apply pressure to the nip portion, wherein
- the roller includes an elastic layer that is deformed by being pressed from a side which the film is placed, such that a distance between a rotation axis of the roller and the nip portion decreases, and that a volume of the elastic layer remains constant, wherein
- the guide portion guides so that regulating members move more to an upstream side in a conveying direction of the recording material as the regulating members approach the rotation axis of the roller.

7. The image heating device according to claim 6, wherein the elastic layer is formed of solid rubber.

8. The image heating device according to claim 6, wherein the guide portion includes a guide surface that is inclined with respect to a plane orthogonal with the conveying direction, so that the nip portion is formed more to the upstream side of the conveying direction as the backup member approaches the roller.

9. The image heating device according to claim 6, wherein the heater is disposed on the backup member.

10. An image forming apparatus, comprising:
- an image forming portion configured to form an image on a recording material; and
- a fixing portion configured to fix an image formed on a recording material to the recording material,
- the fixing portion further comprising:
- a rotatable tubular film;
- a heater that heats the film;
- a rotatable roller that contacts an outer peripheral surface of the film, and forms a nip portion with the film, to convey the recording material;
- a backup member that is disposed in an internal space of the film all through a longitudinal direction of the film, and supports an inner peripheral surface of the film;

regulating members that are disposed to face both ends of the film in the longitudinal direction respectively, so as to regulate a movement of the film in the longitudinal direction, and to move along with the backup member;

a frame of the apparatus, that includes a guide portion to insert the regulating members and a shaft of the roller; and a pressing mechanism that applies force to the regulating members so as to apply pressure to the nip portion, wherein the roller includes an elastic layer that is deformed by being pressed from a side which the film is placed, such that a distance between a rotation axis of the roller and the nip portion decreases and that a volume of the elastic layer decreases, wherein the guide portion guides so that the regulating members move more to a downstream side in a conveying direction of the recording material as the regulating members approach the rotation axis of the roller.

* * * * *